US007325842B1

(12) United States Patent
Lenz

(10) Patent No.: US 7,325,842 B1
(45) Date of Patent: Feb. 5, 2008

(54) AUTOMATIC GATE CLOSER LATCH

(75) Inventor: Don Lenz, Vibank (CA)

(73) Assignee: Prairie Valley Mfg. Inc., Vibank Saskatchewan (CA)

( * ) Notice: Subject to any disclaimer, the term of this patent is extended or adjusted under 35 U.S.C. 154(b) by 0 days.

(21) Appl. No.: 11/524,890

(22) Filed: Sep. 22, 2006

(51) Int. Cl.
*E05C 19/10* (2006.01)

(52) U.S. Cl. ..... 292/120; 292/102; 292/106; 292/218; 292/203; 292/207

(58) Field of Classification Search ..... 292/116–120, 292/218, 102, 106, 203, 207
See application file for complete search history.

(56) References Cited

U.S. PATENT DOCUMENTS 538,078 A * 4/1895 Kerler ..... 292/213
3,355,207 A * 11/1967 Newman ..... 292/78
4,083,591 A * 4/1978 Parisien ..... 292/202
4,111,475 A * 9/1978 McCormick et al. ..... 292/216
4,355,829 A * 10/1982 Gregory ..... 292/68
5,193,307 A * 3/1993 Chupp ..... 49/123
6,711,857 B1 * 3/2004 Wagnitz et al. ..... 49/394

* cited by examiner

*Primary Examiner*—Gary Estremsky

(57) ABSTRACT

An automatic gate closer latch for use in centrally securing a commercial or industrial swinging gate to a stationary fence post, especially useful in the farming and ranching applications, includes a gate catcher assembly mounted on a swivel bolt, complete with directional pressure finders, a bearing tensioner assembly consisting of a bearing tensioner plate, a roller bearing, a tension spring and mounting hardware. The said gate latch catcher assembly is a flat bar segment composed of three right angled bends designed similar to open fingers, to catch the oncoming protruded gate edge post. The directional pressure fingers incorporated in the opposite ends of the gate catcher finger assembly allows the spring tension assembly to maximize its distance in the central neutral position thus causing an automatic closed latch phenomenon. Above normal pressure from an implement on either side of the gate will promote the fingers to open allowing the gate to swing open. The bearing tension assembly consists of a tension spring encircling an all thread bolt promoting pressure to the end roller bearing, all mounted perpendicular to the gate catcher assembly in a sliding tensioning phenomenon through two angle irons mounted on the flat bar mounting irons.

5 Claims, 2 Drawing Sheets

GATE CLOSER LATCH

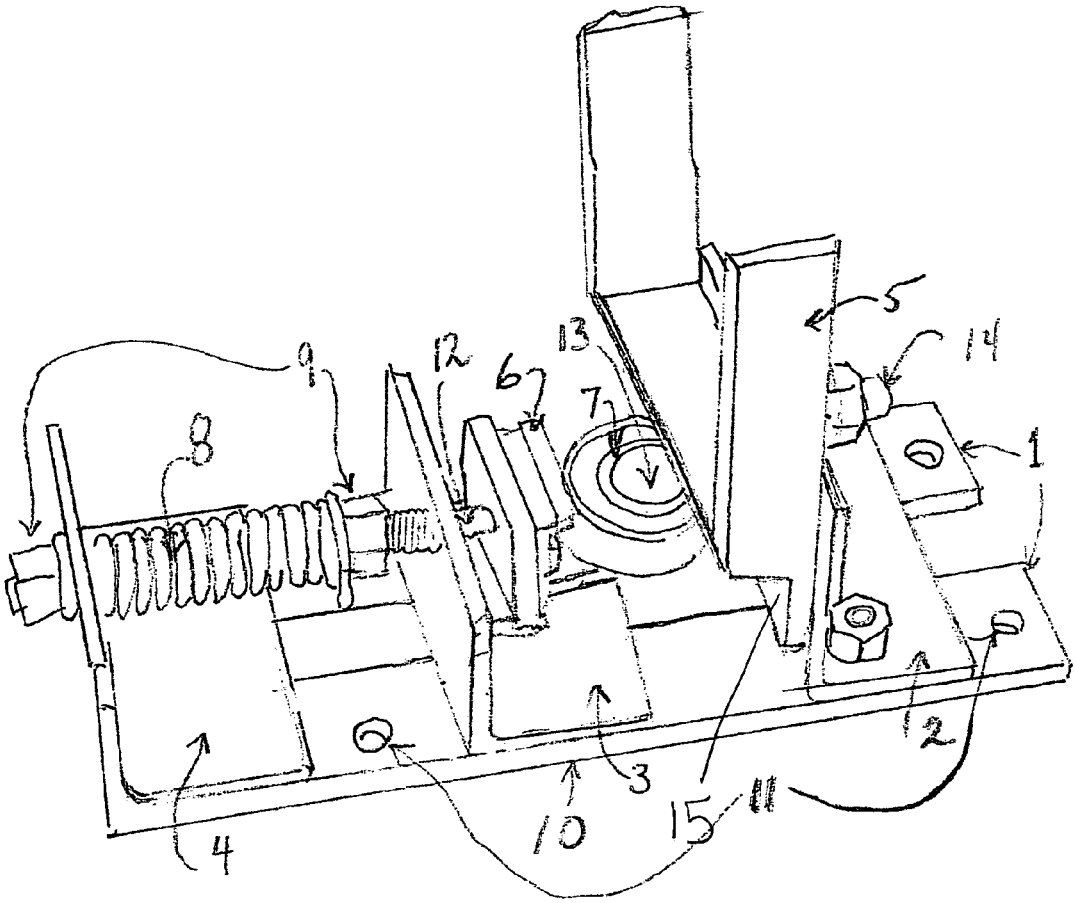
FIG 1 GATE CLOSER LATCH

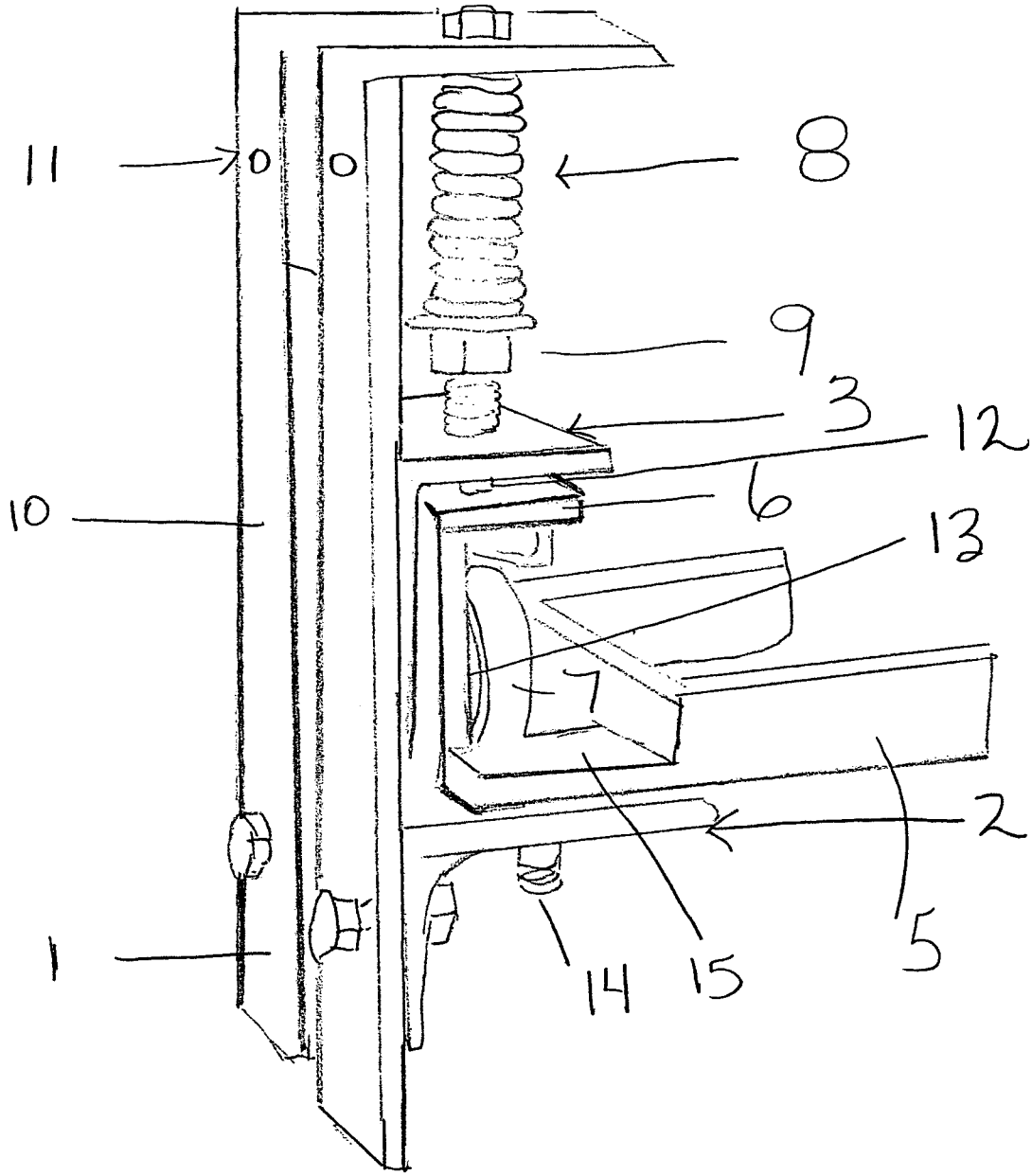
FIG 2 Gate Closer Latch
Actual Use Position

AUTOMATIC GATE CLOSER LATCH

BACKGROUND OF THE INVENTION

The present invention refers to a corral or farm gate latch, which is specifically adapted for the type of gate which can be swung in both directions from the centre axis. This type of gate closer latch simply provides a secure closed position for a gate that opens in either direction.

In the prior art, the most popular style of gate latch is the gravity latch that draws the latch plate down to an extending striker bar operable only from one side of the gate.

Another very common type is the thumb latch which has a release bar that expands through the gate to operate a flat lever style of bolt that is fastened to the fence post via a metal fastening bracket.

There are also two types of barrel-bolt gate latches obtainable; a mechanical bolt slide type requiring human assistance and a spring aided pin which will automatically close on its own as the gate is closed. These types are very unforgiving of any movement in the gate or post structure, therefore requiring regular adjustment.

SUMMARY OF THE INVENTION

It is the object of this invention to provide a low maintenance mechanically automated gate closer latch for the more industrious gates used in commercial, farm and ranch applications, whereby illuminating the need for the operator to physically maneuver off and on the utilized implement in order to secure the desired fenced in livestock.

It is a further object of this invention to provide a gate closer latch mechanism that can accept the gate from both directions while at the same time promoting the self latching ability if the gate were swung shut by a lighter manual closing device. This gate closer latch is highly tolerant to the earth's movement of the gates securing posts due to frost build-up or ground, water, and land movement.

Thus in accordance with the present invention, there is provided a mechanical gate closer latch comprising a gate catcher pivot assembly, a bearing tension bolt assembly and three angle iron mounting flanges, systematically integrated on two mounting flat irons together with associated hardware to form the complete gate closer latch assembly.

The above mentioned gate closer latch assembly is a gate closer latch assembly comprising of various radiused assemblies mounted on flat and angle iron flanges which uses the gate pressure from either side to activate the bearing spring assembly to trap the gate in the middle to secure the gate in a closed mode until the next implement activity forces the catcher pivot assembly to overcome the bearing spring assembly tension to allow the gate to open in the direction the implement operator desires.

Further features of this invention will become apparent in the course of the following detailed description.

BRIEF DESCRIPTION OF THE DRAWINGS

FIG. 1 is a perspective view of the Gate Closer Latch assembly according to the present invention.

FIG. 2 is a side view of the Gate Closer Latch as it appears in an installed position.

DETAILED DESCRIPTION OF THE INVENTION

Referring to FIGS. 1 and 2, a gate latch according to the present invention is specifically exhibited at 20. The gate latch 20 includes a gate catcher assembly, generally indicated at 5, a bearing tensioner assembly 10, three angle iron mounting brackets, 2, 3, 4, and two flat iron mounting flanges 1 completed with mounting holes 11. In the preferred embodiment illustrated, the gate catcher portion 5 is generally a three sided rectangular flat bar assembly, mounted by swivel bolt 14 and to angle iron 1. The open end receives the closing gate member while the other three sides guide the gate member towards the centre position, wherein the bearing tensioner assembly 10 is designed to latch the catcher assembly 5 in the centre position, whereby the spring tensions assembly 10, which includes 6-13, is in it most protruded position.

The spring tensioner assembly 10 is specifically formed of many parts surrounding flat bar member 6 to whereby the end assembly roller bearing 7 is mounted on the bearing mount pin 13, which is mounted on the sliding bearing tensioner bolt assembly 12 all inclusive to provide tension on the outer case of the roller bearing 7, forcing the gate catcher to seek out the centre position to hold its acquired gate-member intact. The tension spring 8, which encircles the all-thread bolt 12, has its tension force predetermined by the force the two nuts and washers that make up the tension hardware 9 provided.

The second position of the gate catcher assembly 5 in the preferred embodiment would be the open position, whereby gate catcher assembly 5 is forced by the large implement thereby pushing the above mentioned assembly to one side or the other, forcing the bearing tensioner assembly back as the fingers 15 are pressured against the roller bearing 7 promoting it to move back which forces the tensioner assembly 10 to load up until the gate returns to the closed position returning the gate closure assembly to return to its original position, relaxing the tensioner assembly.

The gate closer Latch assembly of the present invention is ideally manufactured first by welding on some assemblies and by nut and bolt assembly on the remainder.

The gate closer latch of the present invention, because of its distinctive fabrication, bestows advantages above the existing gate latches. This design forgives all the complications derived from the movement of ground, by frost and water content, causing the raising and lowering of the major gate components. This latch provides a trouble free, automatic system of holding the gate at a firm closed position until the next implement forces it to automatically open, thereby eliminating the need for the operator to get off the implement.

Because of this distinct design the latch does not require any technical skills for installation; the complete gate closer latch can be installed by screwing four bolts to the anchor pole.

The foregoing is considered as illustrative only of the principles of the invention. Further since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. An automatic gate closer for use with a gate member to provide automatic latching when the gate member is pressed into its closed position and automatic unlatching when the gate member is pressed either inwardly or outwardly away from the closed position, the gate closer comprising:

a mounting bracket for retaining the elements of the gate closer as a subassembly for mounting adjacent to the free edge of a swinging gate member, the mounting bracket including at least three flanges generally perpendicular to a vertical main body of the mounting bracket, an integral gate catcher element mounted to a first of mounting bracket flange to pivot about a vertical axis defined by a swivel bolt, the gate catcher including a generally U-shaped latch portion having two extended arms cantilevered in a generally radial direction in a plane that is perpendicular to the pivot axis, the arms being opened towards and configured for catching the gate member therebetween in a gate latched position, the gate catcher also having two extended pressure fingers in the same plane as the arms and cantilevered in a generally radial direction on a side that is opposite of the pivot axis with respect to the arms, the pressure fingers being configured and arranged to provide for a secure and automatic latching of the gate catcher with the gate member in a closed position, a sliding bearing tensioner bolt assembly aligned for generally linear movement along an axis parallel to the pivot axis and having a bearing configured to be movably positioned between the pressure fingers in the latched position, the bearing being pressed downwardly by a coil spring assembly aligned parallel to the pivot axis, the spring assembly including a spring surrounding a bolt that is adjustably mounted through a second and third flanges of the mounting bracket so as to provide for stable movement of the bolt and adjustability of the compressive spring force used to bias the bearing towards the pressure fingers whereby a position of the bearing between the pressure fingers defines a secure latched position of the gate closer when the gate member is closed, and when the gate member is opened, the bearing rides up onto a one or the other pressure finger forcing the spring to further compress.

2. The automatic gate closer of claim 1 further comprising the bearing being a roller bearing.

3. A method of using an automatic gate closer comprising:

providing a mounting bracket for retaining the elements of the gate closer as a subassembly mounted adjacent to a free edge of a swinging gate member, the mounting bracket including at least three flanges generally perpendicular to a vertical main body of the mounting bracket, providing an integral gate catcher element mounted to a first mounting bracket flange to pivot about a vertical axis defined by a swivel bolt, the gate catcher including a generally U-shaped latch portion having two extended arms cantilevered in a generally radial direction in a plane that is perpendicular to the pivot axis, the arms being opened towards and configured for catching the gate member therebetween in a gate latched position, the gate catcher also having two extended pressure fingers in the same plane as the arms and cantilevered in a generally radial direction on a side that is opposite of the pivot axis with respect to the arms, the pressure fingers being configured and arranged to provide for a secure and automatic latching of the gate catcher with the gate member in a closed position, providing a sliding bearing tensioner bolt assembly aligned for generally linear movement along an axis parallel to the pivot axis and having a bearing configured to be movably positioned between the pressure fingers in the latched position, the bearing being pressed downwardly by a coil spring assembly aligned parallel to the pivot axis, the spring assembly including a spring surrounding a bolt that is adjustably mounted through a second and third flanges of the mounting bracket so as to provide for stable movement of the bolt and adjustability of the compressive spring force used to bias the bearing towards the pressure fingers, pressing the gate member closed to be adjacent the automatic gate closer whereby the gate member is caught between the arms as the gate member is swung closed and is rotated by the gate member to a position where the bearing is pressed downwardly to a position between the fingers and thereby secures the gate member in its closed and latched position.

4. The method of claim 3 further comprising:

pressing the gate towards an open position and thereby forcing the bearing to ride up onto one of the pressure fingers and further compressing the spring and allowing the gate member to open.

5. The method of claim 4 further comprising the bearing being a roller bearing.

* * * * *